US007506629B2

(12) United States Patent
Kawamura et al.

(10) Patent No.: US 7,506,629 B2
(45) Date of Patent: Mar. 24, 2009

(54) OIL RETURN STRUCTURE FOR INTERNAL COMBUSTION ENGINE

(75) Inventors: Hiroshi Kawamura, Okazaki (JP); Akihiro Ikeda, Nagoya (JP); Ted Haladyna, Northville, MI (US)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 101 days.

(21) Appl. No.: 11/822,513

(22) Filed: Jul. 6, 2007

(65) Prior Publication Data

US 2008/0011264 A1 Jan. 17, 2008

(30) Foreign Application Priority Data

Jul. 11, 2006 (JP) ..... 2006-190637

(51) Int. Cl.
*F02F 7/00* (2006.01)

(52) U.S. Cl. ..... 123/195 C; 123/572

(58) Field of Classification Search ..... 123/198 DA, 123/198 E, 195 C, 572
See application file for complete search history.

(56) References Cited

U.S. PATENT DOCUMENTS

| | | | | |
|---|---|---|---|---|
| 4,501,234 | A * | 2/1985 | Toki et al. | 123/41.86 |
| 4,616,609 | A * | 10/1986 | Munch et al. | 123/196 AB |
| 4,773,366 | A * | 9/1988 | Seidl et al. | 123/196 R |
| 5,069,192 | A * | 12/1991 | Matsumoto et al. | 123/572 |
| 5,301,642 | A * | 4/1994 | Matsushiro et al. | 123/196 AB |
| 5,452,692 | A * | 9/1995 | Spray et al. | 123/195 C |
| 6,041,752 | A * | 3/2000 | Van Klompenburg | 123/195 C |
| 6,167,990 | B1 * | 1/2001 | Peng | 184/6.2 |
| 6,279,554 | B1 * | 8/2001 | Sayama et al. | 123/572 |
| 6,425,451 | B2 * | 7/2002 | Yoshida et al. | 180/219 |
| 6,431,157 | B1 * | 8/2002 | Marcil | 123/568.11 |
| 6,520,164 | B1 * | 2/2003 | Lepp et al. | 123/572 |
| 6,530,354 | B1 * | 3/2003 | Bishop et al. | 123/195 C |
| 6,598,595 | B2 * | 7/2003 | Yasui | 123/572 |
| 6,640,767 | B2 * | 11/2003 | Kato et al. | 123/195 C |
| 6,854,454 | B2 * | 2/2005 | Obayashi et al. | 123/572 |
| 6,920,869 | B2 * | 7/2005 | Murata et al. | 123/572 |
| 7,047,955 | B2 * | 5/2006 | Ookawa et al. | 123/572 |
| 7,069,899 | B1 * | 7/2006 | Okuda et al. | 123/195 C |
| 7,322,335 | B2 * | 1/2008 | Suzuki et al. | 123/195 C |
| 7,373,911 | B2 * | 5/2008 | Taguchi | 123/195 C |
| 2002/0129783 | A1 * | 9/2002 | Lawrence | 123/195 C |

FOREIGN PATENT DOCUMENTS

| | | |
|---|---|---|
| JP | Y2 63-37463 | 10/1988 |
| JP | U 1-134714 | 9/1989 |

* cited by examiner

*Primary Examiner*—Hai H Huynh
(74) *Attorney, Agent, or Firm*—Oliff & Berridge, PLC

(57) ABSTRACT

An oil pan is provided below a crankcase of an engine. The oil pan has an oil reservoir in its upper case. An oil discharge pipe is located within the oil reservoir, the oil discharge pipe extending from an oil separator of a PCV system. The oil reservoir protrudes inward of an inner wall surface of a lower case. The oil reservoir has an oil drain hole on a bottom surface at its inwardly protruding portion. The oil reservoir communicates with a lower chamber through the oil drain hole.

8 Claims, 10 Drawing Sheets

OIL RETURN STRUCTURE FOR INTERNAL COMBUSTION ENGINE

INCORPORATION BY REFERENCE

The disclosure of Japanese Patent Application No. 2006-190637 filed on Jul. 11, 2006 including the specification, drawings and abstract is incorporated herein by reference in its entirety.

BACKGROUND OF THE INVENTION

1. Field of the Invention

The present invention relates to an oil return structure for an internal combustion engine.

2. Description of the Related Art

In a known art, an oil pan is located at the bottom of the crankcase of an internal combustion engine. The oil pan holds oil (lubricating oil) to lubricate and cool moving (sliding) engine parts. Oil held in the oil pan is delivered to the respective engine parts by the oil pump when the engine runs. After lubricating and cooling these engine parts, oil returns to and is collected in the oil pan. For example, oil is delivered to the engine cylinder head, lubricates the valve driving system, and then drops back down into the oil pan.

According to the known art, the engine cylinder head and cylinder block have an oil return hole. Oil returns to the oil pan through the oil return hole, after being delivered to the cylinder head and lubricating the valve driving system. The oil return hole serves as an oil return passage to communicate the cam chamber, located at the upper side of the engine, with the crank chamber, located at the lower side of the engine lower.

According to another known art, the engine has a positive crankcase ventilation system (hereinafter referred to as "PCV system"), in which the oil separator separates oil from blow-by gas to return the oil to the oil pan through the oil discharge pipe. Oil or vaporized oil is separated from blow-by gas by the oil separator. While the oil returns to the oil reservoir in the oil pan through the oil discharge pipe, any oil remaining in blow-by gas flows to the engine intake system.

Intake-manifold vacuum acts on the oil separator in the PCV system in order to return blow-by gas collected from the crank chamber to the intake system. This results in lower pressure in the oil separator than in the crank chamber and the cam chamber. Thus, airflow is generated that flows into the oil separator through the oil discharge pipe. Accordingly, this airflow may cause blow-by gas containing a large amount of vaporized oil to flow into the intake system without through the oil separating mechanism provided in the oil separator. Therefore, in order to prevent such backflow of blow-by gas, preferably the downstream end of the oil discharge pipe is submerged in oil constantly.

FIG. 11 shows an example of the related-art oil pan structure. FIG. 11 is a sectional view illustrating a part of an oil pan 111 located below the engine crankcase. The oil pan 111 has a two-part structure, in which the oil pan 111 is divided into an upper case 112 and a lower case 113. The upper case 112 has an oil reservoir 114 on its one end. An oil discharge pipe 115 is provided in a crankcase to return oil from the upper part of the engine into the oil pan 111. The oil discharge pipe 115 has a downstream end located in the oil reservoir 114. The downstream end 115*a* of the oil discharge pipe 115 remains submerged in oil in the oil reservoir 114. In addition, the oil reservoir 114 has an oil drain hole 114*a* on its side surface 114*b*, so that oil in the oil reservoir 114 flows out through the oil drain hole 114*a* into the oil pan 111.

An example of the oil return structure is shown in JP-U-Hei 1-134714. This oil return structure is designed to prevent backflow of blow-by gas, while preventing oil from flowing out of the oil pan due to dislodgement of the oil discharge pipe. More specifically, the oil return structure, disclosed in JP-U-Hei 1-134714, is designed to return oil, separated from blow-by gas, to the oil pan through the oil return passage (oil discharge pipe). In the oil pan, the bottom section of the oil return passage is formed into a U-shape with its one end opened upward. The open end is located at a height between low oil level and high oil level in the oil pan. At the low oil level, a minimum allowable oil amount is ensured. At the high oil level, as well as a maximum allowable oil amount at the full level, an amount of additional oil to be absorbed by the lubricated parts are also ensured. In addition, the height from the bottom-most part of the U-shaped section to the open end is specified at a given height or greater such that no blow-by gas flows beyond the bottom-most part.

In the oil pan structure shown in FIG. 11, the side surface 114*b* of the oil reservoir 114 is located outward of the inner wall 113*a* of the lower case 113 (inner wall of the bottom part of the oil pan 111). This limits the location of the oil drain hole 114*a* to the side surface 114*b* of the oil reservoir 114. Thus, the only way to form the oil drain hole 114*a* is to obliquely drill the side surface 114*b* of the oil reservoir 114 from above. In addition, drilling limits the cross sectional shape of the oil drain hole 114*a* to circle. Also, total machining costs disadvantageously increases due to additional drilling. Further, oil at the bottom of the oil reservoir 114 flows less easily out of the oil drain hole 114*a*. This results in another disadvantage of sludge built up in the oil reservoir 114.

In turn, the engine oil return structure, disclosed in JP-U-Hei 1-134714, has the following problems. The U-shaped bottom section of the oil return passage has the upwardly open end. Thus, when the engine runs, oil flows through the oil return passage and returns to the oil pan through the open end of the U-shaped bottom section. In contrast, sludge flowing out through the oil return passage does not flow upward to the open end, but is deposited on the bottom-most part of the U-shaped section. In addition, the oil return passage need be long enough to extend from the upper part of the engine to the interior of the oil pan. In view of this, the longer oil return passage is more likely to interfere with components in the crankcase, and to avoid the interference, the oil return passage need be provided outside the crankcase.

SUMMARY OF THE INVENTION

The present invention provides an oil return structure for an internal combustion engine that prevents backflow of blow-by gas, ensures that oil at a bottom of an oil reservoir in an oil pan flows out of an oil drain hole, and prevents sludge from building up in the oil reservoir.

A first aspect of the invention is directed to an oil return structure for an internal combustion engine, including: an oil pan located below a crankcase of the internal combustion engine; an oil return passage provided in the crankcase to return oil from an upper part of the internal combustion engine into the oil pan; and an oil reservoir formed in an upper part of the oil pan, in which the oil return passage has a downstream end located within the oil reservoir, the oil reservoir protrudes inward of an inner wall surface of a lower part of the oil pan (a part below the oil reservoir), an oil discharge hole is formed on a bottom surface of the oil reservoir at an inwardly protruding portion of the oil reservoir, and the oil reservoir communicates through the oil discharge hole with a space defined by the lower part of the oil pan. One example of the oil return passage is an oil discharge pipe that extends from an oil separator of a positive crankcase ventilation system provided on a top of the internal combustion engine.

According to the first aspect of the invention, the oil discharge hole is formed on the bottom surface of the oil reservoir at the inwardly protruding portion thereof. The oil discharge hole is thus a through hole extending through the bottom surface of the oil reservoir in a direction to remove a die-casting mold for the oil pan. Therefore, the oil drain hole is obtained by removing the mold in the process of forming (molding) the oil pan. There is thus no need for additional machining process, such as drilling, for forming the oil discharge hole, thereby reducing total machining costs. In addition, unlike the case of drilling, to form the oil discharge hole by taking advantage of molding does not limit the cross-sectional shape of the oil discharge hole to circle. This provides greater flexibility in selecting the shape of the hole.

Also, this ensures that oil does not stay at the bottom of the oil reservoir, but flows out of the oil reservoir through the oil discharge hole. Thus, oil circulation improves. In addition, oil, sludge and other materials also flow out of the oil reservoir through the oil discharge hole, and are therefore prevented from accumulating in the oil reservoir.

Preferably, oil level positions within and outside the oil reservoir in the oil pan, in other words, an oil level in the oil pan and an oil level in the oil reservoir, are predetermined to satisfy the following relationship. When the internal combustion engine is stopped, the oil level in the oil reservoir is above the downstream end of the oil return passage. When the internal combustion engine is running, the oil level in the oil pan is below the bottom surface of the oil reservoir, while the oil level in the oil reservoir is above the downstream end of the oil return passage. An open area of the oil discharge hole is predetermined based on an amount of oil flowing back to the oil reservoir and an amount of oil flowing out of the oil discharge hole, in order to satisfy the aforementioned relationship of the oil level positions between within and outside the oil reservoir.

Thus, when the internal combustion engine is stopped, the downstream end of the oil return passage is submerged in oil in the oil reservoir, and the oil in the oil reservoir clogs the downstream end of the oil reservoir. This prevents backflow of blow-by gas through the oil return passage when the internal combustion engine starts. Even when the oil level in the oil pan is lowered when the internal combustion engine is running, the downstream end of the oil return passage remains submerged in oil in the oil reservoir. Thus, backflow of blow-by gas through the oil return passage is also prevented when the internal combustion engine is running. The oil reservoir may be provided on the upper part of the oil pan, so that the oil return passage is located where it does not interfere with components in the crankcase.

A second aspect of the invention is directed to an oil return structure for an internal combustion engine, including: an oil pan located below a crankcase of the internal combustion engine; an oil return passage provided in the crankcase for returning oil from an upper part of the internal combustion engine into the oil pan; and an oil reservoir formed in an upper part of the oil pan, in which the oil return passage has a downstream end located within the oil reservoir, an oil discharge hole is formed on a side surface of the oil reservoir at a lowest part of the oil reservoir, the oil reservoir communicates through the oil discharge hole with a space defined by a lower part of the oil pan (a part below the oil reservoir), and at least a part of the bottom surface of the oil reservoir is tilted downward toward the oil discharge hole.

The second aspect of the invention prevents backflow of blow-by gas, ensures that oil at the bottom of the oil reservoir in the oil pan flows out of the oil discharge hole, and prevents sludge from accumulating in the oil reservoir.

BRIEF DESCRIPTION OF THE DRAWINGS

The foregoing and further features and advantages of the invention will become apparent from the following description of example embodiments with reference to the accompanying drawings, wherein like numerals are used to represent like elements and wherein.

DETAILED DESCRIPTION OF THE INVENTION

Example embodiments of the invention will be described below with reference to the accompanying drawings.

An oil return structure of the invention that is applied to a V-type engine (internal combustion engine) for automobile will be described below.

Figure 1:
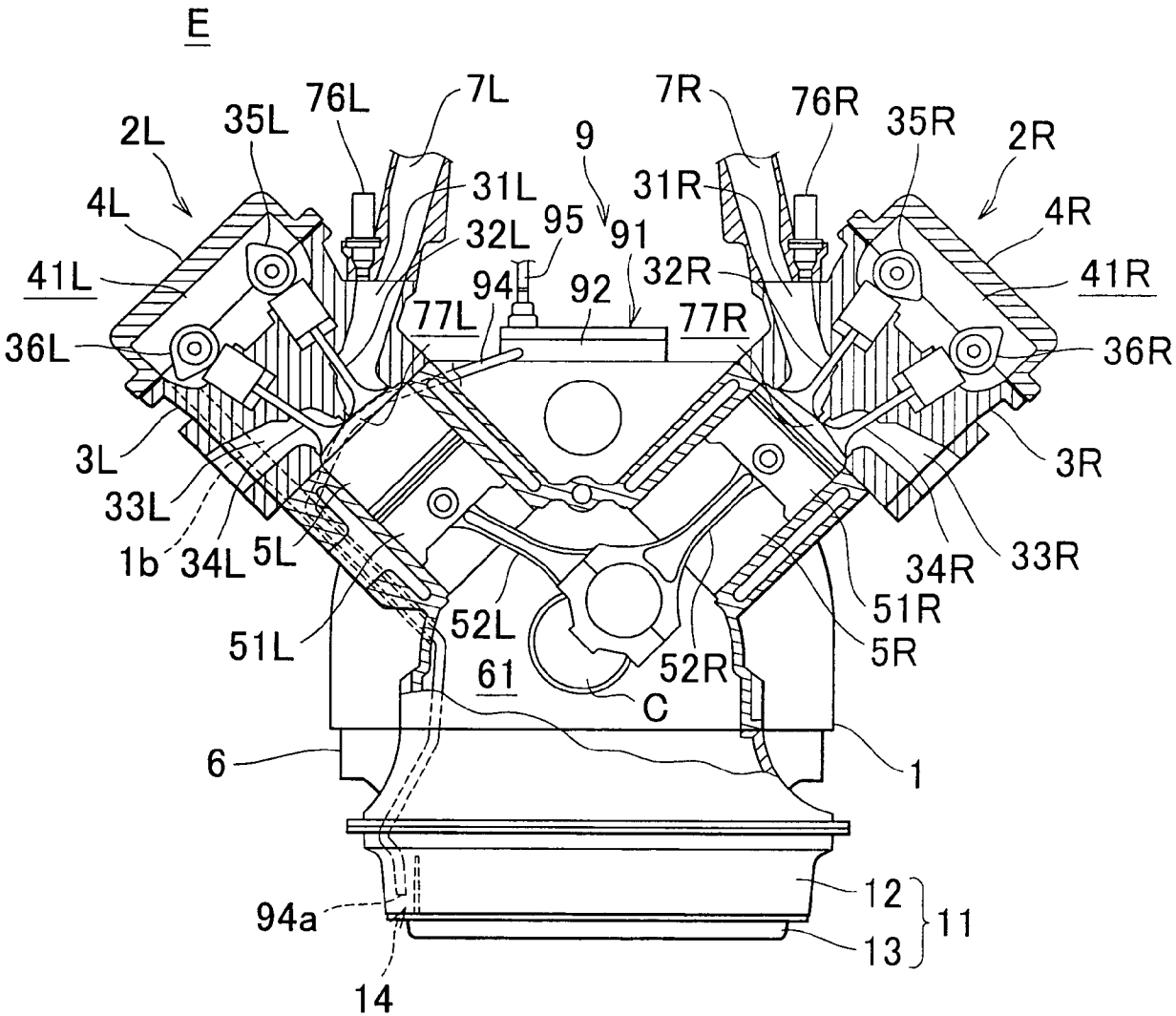
FIG. 1 schematically illustrates an interior of a V-type engine according to the first embodiment of the invention.
Figure 2:
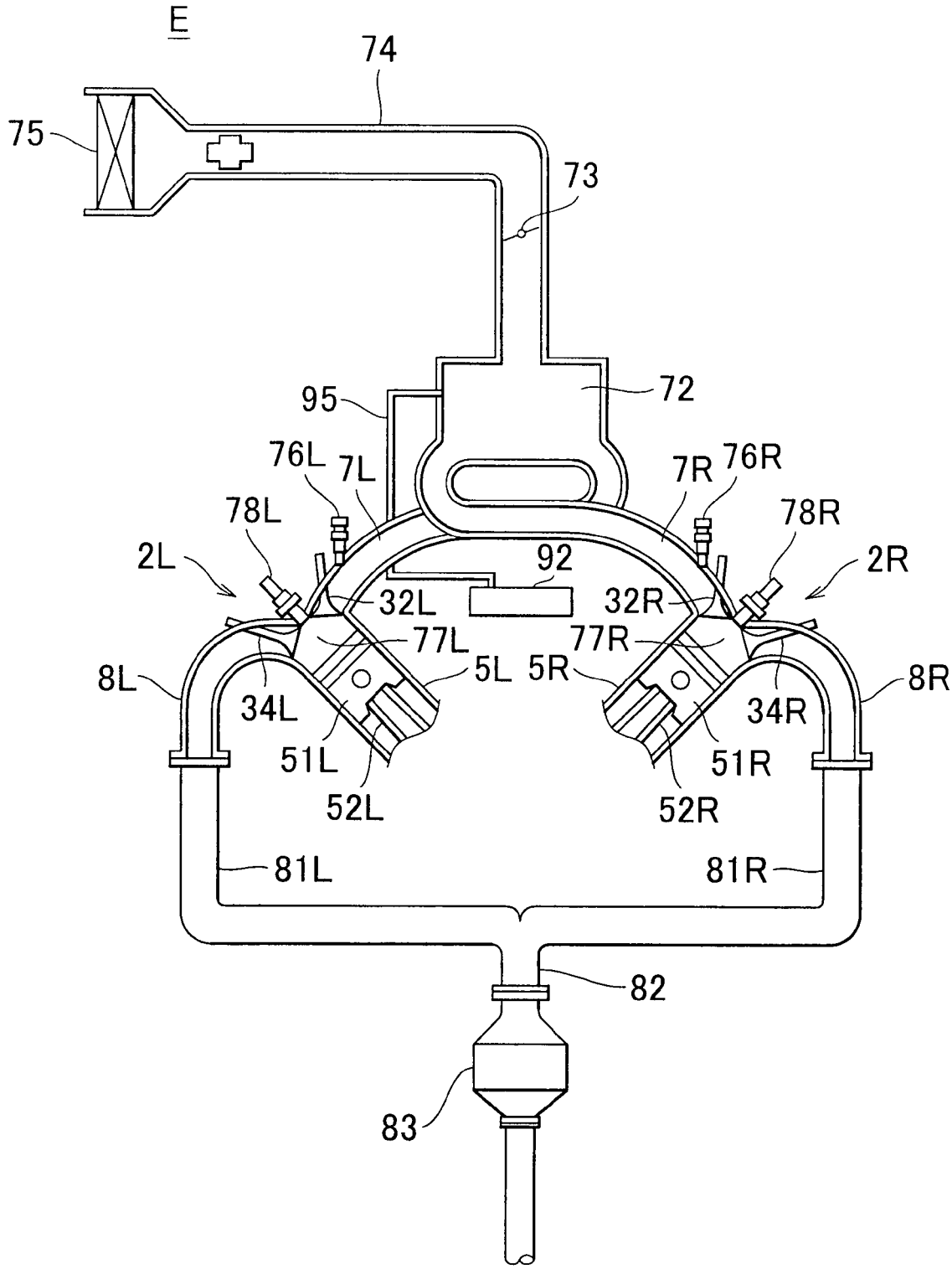
FIG. 2 is a schematic system structure diagram of the engine, an intake system, and an exhaust system.
Figure 3A:
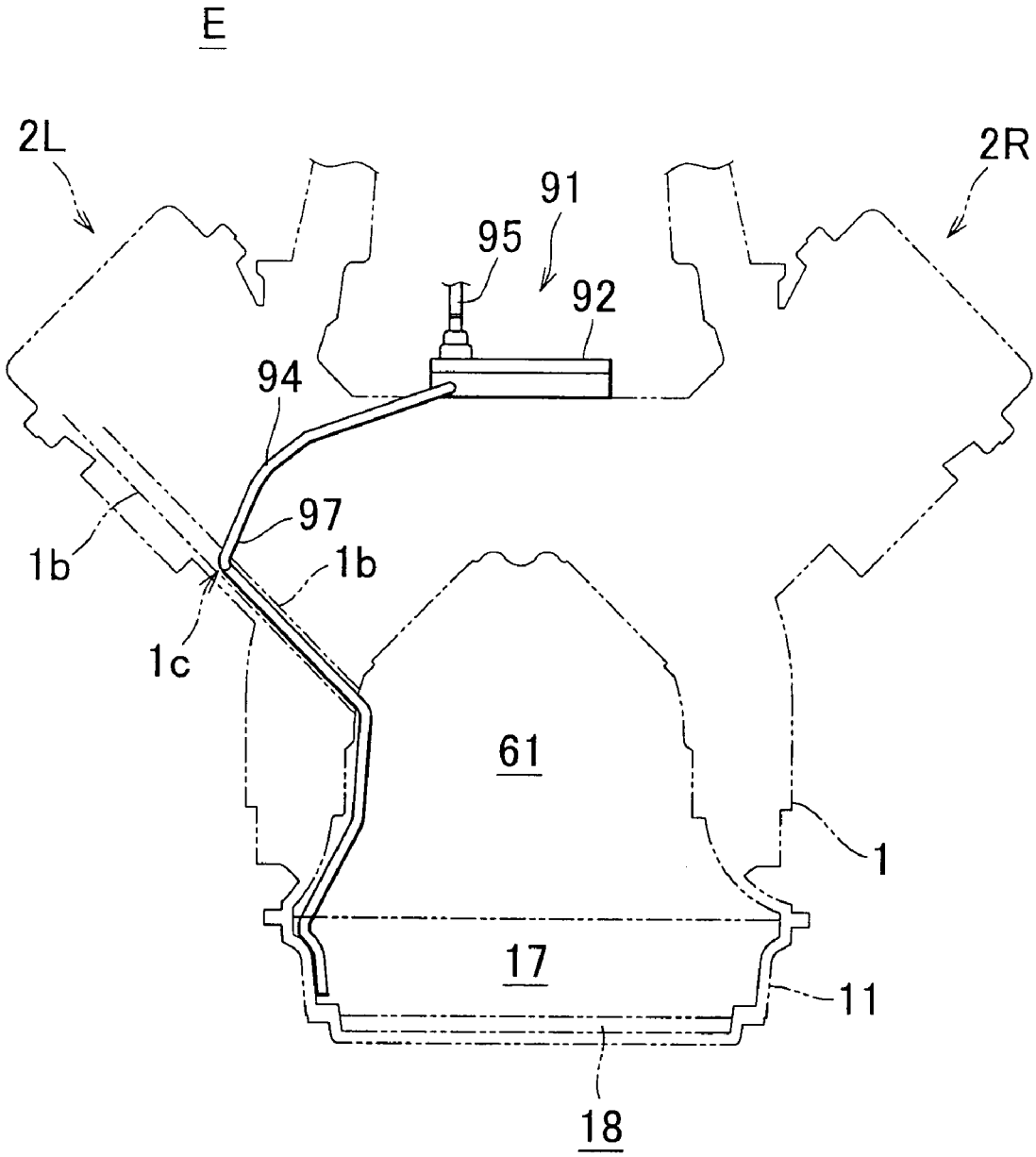
FIG. 3A is a rear view of the engine provided with a PCV system having an oil separator including a separator case, in which the separator case is mounted on the engine.
Figure 3B:
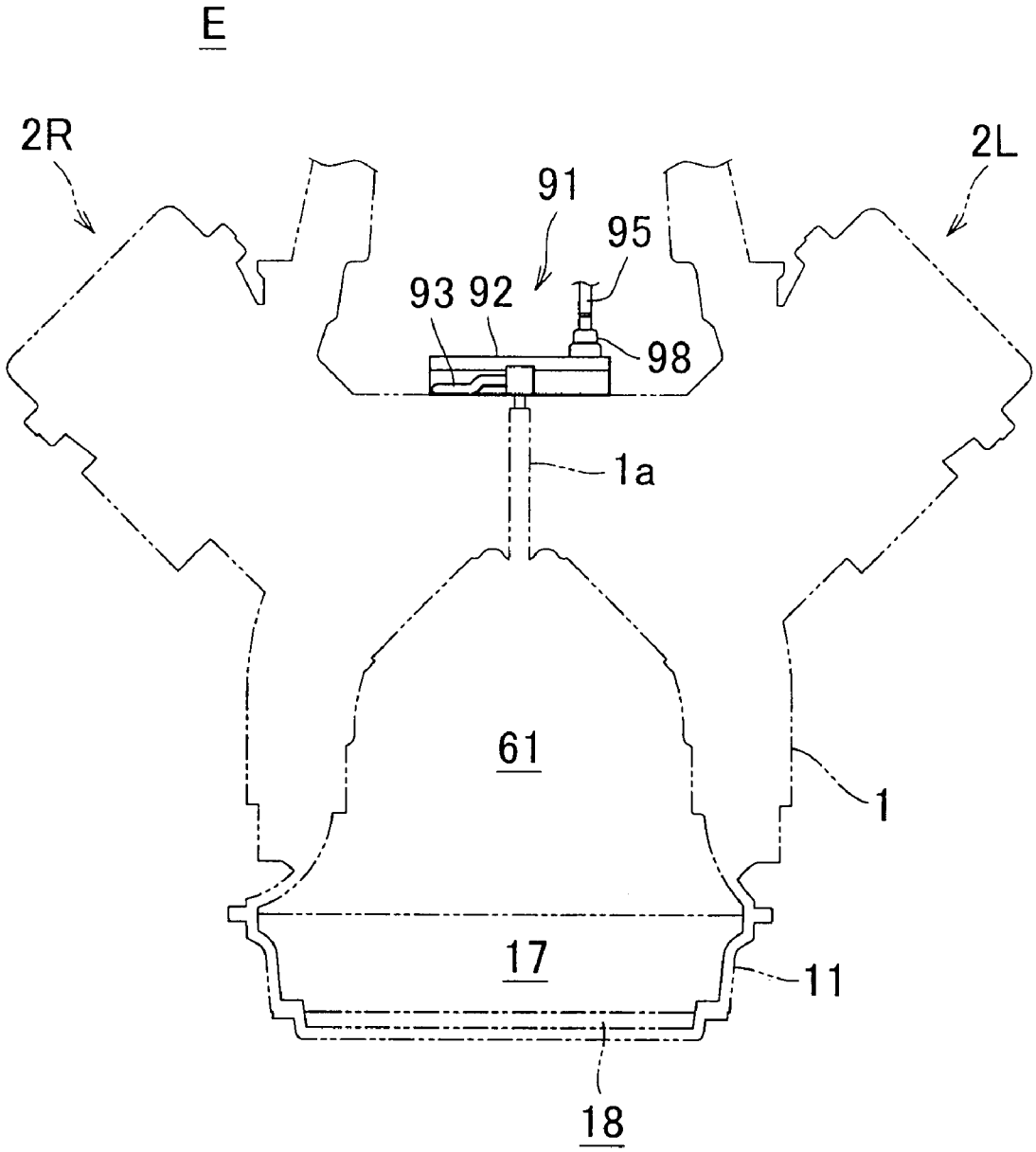
FIG. 3B is a front view of the engine provided with the PCV system having the oil separator including the separator case, in which the separator case is mounted on the engine.

First, an overall structure of the V-type engine E (hereinafter sometimes referred to as engine) is described with reference to FIGS. 1 to 3. FIG. 1 schematically shows an interior of the V-type engine E, when viewed in the axial direction of a crankshaft C. FIG. 2 is a schematic system structure diagram of the V-type engine E, an intake system, and an exhaust system. FIGS. 3A and 3B show the V-type engine E provided with a PCV system having an oil separator including a separator case, in which the separator case is mounted between banks of the engine E (the outline of the engine E and the form of a crank chamber are shown in the phantom lines). FIG. 3A is a rear view of the engine E. FIG. 3B is a front view of the engine E.

The engine E has a pair of banks 2L and 2R above a cylinder block 1. The banks 2L and 2R protrude to form a V-shape. The banks 2L and 2R have cylinder heads 3L and 3R and head covers 4L and 4R, respectively. The cylinder heads 3L and 3R are disposed on the upper end of the cylinder block 1. The head covers 4L and 4R are mounted to the respective top ends of the cylinder heads 3L and 3R. In the cylinder block 1, plural pairs of cylinders 5L and 5R, . . . (e.g. three cylinders for each bank 2L, 2R) are disposed with a predetermined angle (e.g. 90 degrees) between the paired cylinders. Pistons 51L and 51R . . . are accommodated in the corresponding cylinders 5L and 5R . . . such that each piston can reciprocate. The pistons 51L and 51R . . . are connected to a crankshaft C respectively through connecting rods 52L and 52R . . . such that power is transmitted from each piston to the crankshaft C.

A crankcase 6 is mounted to the underside of the cylinder block 1. An internal space, which extends from the lower part of the cylinder block 1 to the crankcase 6, forms a crank chamber 61. An oil pan 11 is disposed below the crankcase 6. The oil pan 11 is designed to hold oil that is used to lubricate and cool moving (sliding) engine E parts. The oil return structure in the engine E for returning oil to the oil pan 11 will be discussed later.

Intake valves 32L and 32R for opening or closing respective intake ports 31L and 31R are assembled to the cylinder heads 3L and 3R. In turn, exhaust valves 34L and 34R for opening or closing respective exhaust ports 33L and 33R are assembled to the cylinder heads 3L and 3R. Cam chambers 41L and 41R are defined respectively between the cylinder head 3L and the head cover 4L and between the cylinder head 3R and the head cover 4R. Camshafts 35L and 36L and camshafts 35R and 36R are located in the respective cam chambers 41L and 41R. Rotations of these camshafts 35L, 35R, 36L, 36R allow the associated valves 32L, 32R, 34L, 34R to operate to the open or closed position.

An oil return hole 1*b* is formed in the one of the banks of the engine E (left bank 2L in this embodiment). The oil return hole 1*b* is designed to return (recover) oil, used for lubricating a valve driving system in the engine E, to the oil pan 11. The oil return hole 1*b* extends through the cylinder head 3L to the upper part of the cylinder block 1. An upper end of the oil return hole 1*b* is open to the cam chamber 41L, while a lower end thereof is open to the crank chamber 61. This allows oil, which has been delivered to the cam chamber 41L and that has lubricated the valve driving system, to drop back down into the oil pan 11 through the oil return hole 1*b*. Oil flowing out of the bottom end of the oil return hole 1*b* drops down into the oil pan 11 through the crank chamber 61. An oil discharge pipe 94 of a PCV system 9 is inserted into a part of the oil return hole 1*b*. The PCV system 9 will be discussed later.

Intake manifolds 7L and 7R associated with the banks 2L and 2R are disposed on the upper inner sides of the corresponding banks (the side closer to a space between the banks). The respective downstream ends of the intake manifolds 7L and 7R communicate with the associated intake ports 31L and 31R. The intake manifolds 7L and 7R also communicate with an intake pipe 74 having a surge tank 72 and a throttle valve 73. The intake pipe 74 is shared between the banks. An air cleaner 75 is provided upstream of the intake pipe 74. Air introduced from the air cleaner 75 into the intake pipe 74 is directed through the surge tank 72 to the intake manifolds 7L and 7R.

Injectors (fuel injection valves) 76L and 76R are respectively provided on the intake manifolds 7L and 7R. Air directed into the intake manifolds 7L and 7R is mixed with fuel sprayed from the injectors 76L and 76R. This air-fuel mixture is directed to combustion chambers 77L and 77R when the intake valves 32L and 32R open. Ignition plugs 78L and 78R are individually disposed on the top of the combustion chambers 77L and 77R.

In the combustion chambers 77L and 77R, the ignition plugs 78L and 78R ignite the air-fuel mixture, and combustion gas is produced by burning the air-fuel mixture. This combustion gas is discharged as exhaust gas to exhaust manifolds 8L and 8R, when the exhaust valves 34L and 34R open. The exhaust manifolds 8L and 8R connect to exhaust pipes 81L and 81R, respectively. The exhaust pipes 81L and 81R connect to a common collecting exhaust pipe 82. A three-way catalytic converter 83 is provided on the collecting exhaust pipe 82. Exhaust gas, discharged to the exhaust manifolds 8L and 8R, passes through the exhaust pipes 81L and 81R and the collecting exhaust pipe 82, and is emitted outside. When exhaust gas passes through the catalytic converter 83, the catalytic converter 83 purifies the exhaust gas by removing HC, CO, and $NO_x$.

The engine E is provided with the PCV system 9. Blow-by gas flows through a gap between the inner surface of the cylinder 5L and the outer surface of the piston 51L and a gap between the inner surface of the cylinder 5R and the outer surface of the piston 51R and through the crank chamber 61. The PCV system 9 is designed to direct such blow-by gas to the intake system.

The PCV system 9 has an oil separator 91 disposed on the cylinder block 1 between the banks 2L and 2R. The oil separator 91 includes a separator case 92, as well as a blow-by gas introducing pipe 93, an oil discharge pipe 94, and a blow-by gas discharge pipe 95, which are individually connected to the separator case 92.

The separator case 92 separates vaporized oil from blow-by gas drawn through the crank chamber 61 by the blow-by gas introducing pipe 93. The separator case 92 is mounted on a horizontal top surface of the cylinder block 1 between the banks 2L and 2R with a bolt or other means. The separator case 92 has a punching plate and a baffle plate therein, forming a blow-by gas flow passage. So-called inertial impaction works to trap vaporized oil in the separator case 92.

The blow-by gas introducing gas pipe 93 is designed to draw blow-by gas flowing through the crank chamber 61 and direct the blow-by gas into the separator case 92. An upstream end of the blow-by gas introducing pipe 93 connects to the top surface of the cylinder block 1 between the banks. More specifically, the cylinder block 1 has a blow-by gas recovery passage 1*a* therein. One end of the blow-by gas recovery passage 1*a* is open to the crank chamber 61, while the other end thereof is open to the top surface of the cylinder block 1 between the banks. The upstream end of the blow-by gas introducing pipe 93 communicates with the blow-by gas recovery passage 1*a*. This allows blow-by gas in the crank chamber 61 to be directed from the blow-by gas recovery passage 1*a* via the blow-by introducing pipe 93 into the separator case 92.

The blow-by gas discharge pipe 95 directs blow-by gas, whose oil content has been separated and removed in the separator case 92, to the intake system in the engine E. A downstream end of the blow-by gas discharge pipe 95 connects to the surge tank 72 in order to return blow-by gas to the intake system through the surge tank 72. A PCV valve 98 is provided at the upstream end of the blow-by discharge pipe 95. When the PCV valve 98 opens due to intake-manifold vacuum, blow-by gas flows out of the separator case 92 to the blow-by gas discharge pipe 95 and is directed to the surge tank 72.

The oil discharge pipe 94 returns both oil and vaporized oil, which has been separated and removed from blow-by gas in the separator case 92, to the oil pan 11. The oil discharge pipe 94 serves as an oil return passage (oil recovery passage) for returning oil to an oil reservoir 14 in the oil pan 11, as will be discussed later. The oil discharge pipe 94 is disposed across the exterior and the interior of the engine E. More specifically, the oil discharge pipe 94 is directed from the exterior to the interior of the engine E via a through hole 1*c* formed on the rear surface of the left bank 2L of the engine E. Outside the engine E, the oil discharge pipe 94 extends from an oil discharge port to the through hole 1*c*, the oil discharge port being formed on the side surface of the separator case 92. An intermediate part of the oil discharge pipe 94 is connected to the interior of the engine E via the through hole 1*c*, while sealing a gap between the pipe 94 and the hole 1*c*. In turn, inside the engine E, the oil discharge pipe 94 extends from the through hole 1*c* to the oil reservoir 14 in the oil pan 11. A part of the oil discharge pipe 94, which is located in the left bank 2L, is inserted into the oil return hole 1*b*. The other part of the oil discharge pipe 94, which is downstream of the oil return hole 1*b*, extends from the bottom end of the hole 1*b* through the crank chamber 61. In the crank chamber 61, the downstream portion of the oil discharge pipe 94 is located along the inner wall of the crankcase 6 to avoid interference with components therein. The downstream end of the oil discharge pipe 94 is located within the oil reservoir 14 in the oil pan 11, which will be discussed later.

As described above, the oil discharge pipe 94 extends from the oil discharge port of the separator case 92 through the exterior of the engine E, the through hole 1*c*, the oil return hole 1*b*, and the crank chamber 61 to the oil reservoir 14. Oil separated from blow-by gas in the separator case 92 is returned to the oil pan 11 through the oil discharge pipe 94. The interior of the engine E has a double pipe structure in which the oil discharge pipe 94 is inserted into the oil return hole 1*b*. First oil returns to the oil pan 11 through the oil return hole 1*b* after being delivered to the cylinder head 3L (cam chamber 41L) and lubricating the valve driving mechanism. Second oil returns to the oil pan 11 through the oil discharge pipe 94 after being separated from blow-by gas in the separator case 92. The double pipe structure is designed to prevent mixing of the first oil with the second oil.

The engine E has a fresh air introducing path therein for introducing fresh air into the crank chamber 61. As blow-by gas is recirculated in the described manner, fresh air is introduced from the fresh air introducing path into the crank chamber 61 for ventilation.

The oil return structure in the engine E for returning oil to the oil pan 11 (oil recovery structure) is now described in details.

Figure 4:
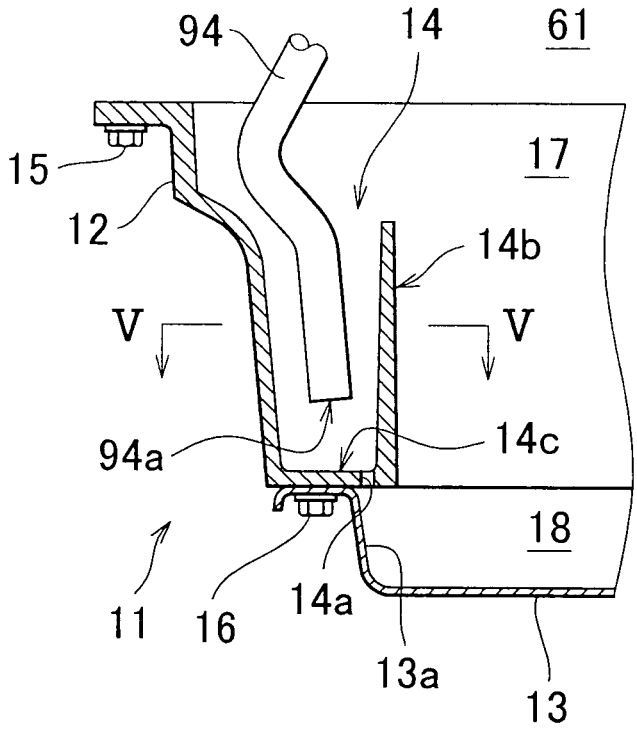
FIG. 4 is a sectional view of an oil reservoir in an oil pan.
Figure 5:
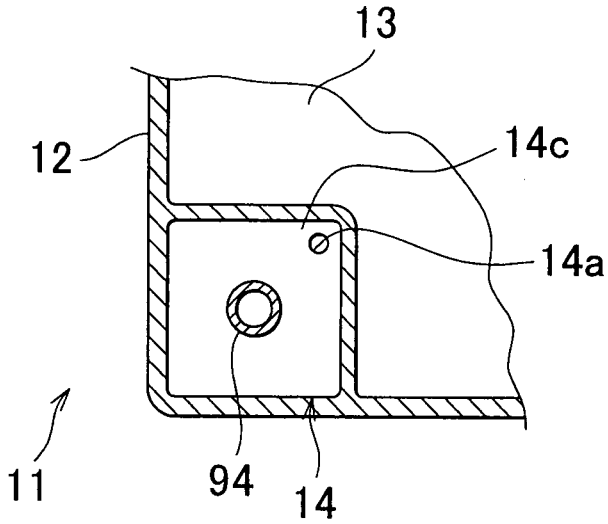
FIG. 5 is a sectional view taken along the line X-X in FIG. 4.

As shown in FIGS. 4 and 5, the oil pan 11 has a two-part structure in which the oil pan 11 is divided into an upper case 12 and a lower case 13. For example, the upper case 12 is a die-cast aluminum (aluminum alloy) structure, while the lower case 13 is made of cast-iron. The upper case 12 is attached to the underside of the crankcase 6 in a sealed manner with a bolt 15. The lower case 13 is attached to the underside of the upper case 12 in a sealed manner with a bolt 16. Below the crank chamber 61, the upper case 12 defines a space as an upper chamber 17. Below the upper chamber 17, the lower case 13 defines a space as a lower chamber 18.

The oil pan 11 holds oil that is used to lubricate and cool the moving parts of the engine E. Oil collected in the oil pan 11 is delivered to the respective parts of the engine E by an oil pump (not shown) when the engine E is running. After lubricating and cooling the parts of the engine E, oil returns to and is collected in the oil pan 11. For example, oil is delivered to the cylinder heads 3L and 3R (cam chambers 41L and 41R) and lubricates the valve driving system in the engine E. Then, the oil drops back down into the oil pan 11. Portion of the oil delivered to the cylinder head 3L and used for lubricating the valve driving system flows through the oil return hole 1*b* back to the oil pan 11. In contrast, oil is separated from blow-by gas in the separator case 92 of the oil separator 91 in the PCV system 9, and then flows through the oil discharge pipe 94 back to the oil pan 11.

The upper case 12 has an oil reservoir 14 at one of its corners. The oil reservoir 14 temporarily holds the oil to flow back to the oil pan 11 in the manner described as follows. The oil reservoir 14 is provided adjacent to the upper chamber 17. More specifically, the oil reservoir 14 has an inward portion (facing the upper chamber 17 or the right portion in FIG. 4) protruding inward of an inner wall surface 13*a* of the lower case 13 (inner wall surface of the lower part of the oil pan 11). That it, the outer wall surface 14*b* of the oil reservoir 14 is located inward of the inner wall surface 13*a* of the lower case 13. In other words, a portion of the oil reservoir 14, which is located above the lower chamber 18, extends toward the upper chamber 17.

The oil reservoir 14 has a bottom surface 14*c*. An oil drain hole (oil discharge hole) 14*a* is formed on the bottom surface 14*c* at the inwardly protruding portion of the oil reservoir 14. The oil reservoir 14 communicates with the lower chamber 18 through the oil drain hole 14*a*. In the oil pan structure, the oil reservoir 14 protrudes inward, and has the oil drain hole 14*a* on the bottom surface 14*c* at its inwardly-protruding portion. The oil drain hole 14*a* is a through hole that extends through the bottom surface 14*c*. In this embodiment, the through hole extends in the direction to remove a die-casting mold for the oil pan 11. The oil drain hole 14*a* is formed when the oil pan is removed from the die-casting mold when the oil pan is formed. There is thus no need for additional machining process, such as drilling, to form the oil drain hole 14*a*, thereby reducing total machining costs. In addition, by forming the oil drain hole 14*a* by taking advantage of molding, the cross-sectional shape of the oil drain hole 14*a* is not limited to circle. This provides greater flexibility in selecting the shape of the hole. An open area of the oil drain hole 14*a* is predetermined based on the amount of oil flowing back to the oil reservoir 14 and the amount of oil flowing out of the oil drain 14*a*, in order to satisfy a relationship of the oil level positions between within and outside the oil reservoir 14. This relationship will be discussed later.

The downstream end of the oil discharge pipe 94, extends from the separator case 92 of the oil separator 91 in the PCV system 9, and is introduced into the oil reservoir 14. The oil reservoir 14 collects oil that has flowed back from the separator case 92 through the oil discharge pipe 94. The oil reservoir 14 is provided below the oil return hole 1*b*. This permits some oil, which flows back through the oil return hole 1*b* and the crank chamber 61, to drop into the oil reservoir 14, and to be held therein. In addition, some oil, which drops down toward the oil pan 11, can also be reserved in the oil reservoir 14.

The oil level positions within and outside the oil reservoir 14 in the oil pan 11 in the described configuration satisfy the following relationship. The level of oil held within the oil reservoir 14 in the oil pan 11 is hereinafter referred to as "oil level in the oil reservoir." The level of oil held between the outside of the oil reservoir 14 and the inside of the oil pan 11 is hereinafter referred to as "oil level in the oil pan."

Figure 6A:
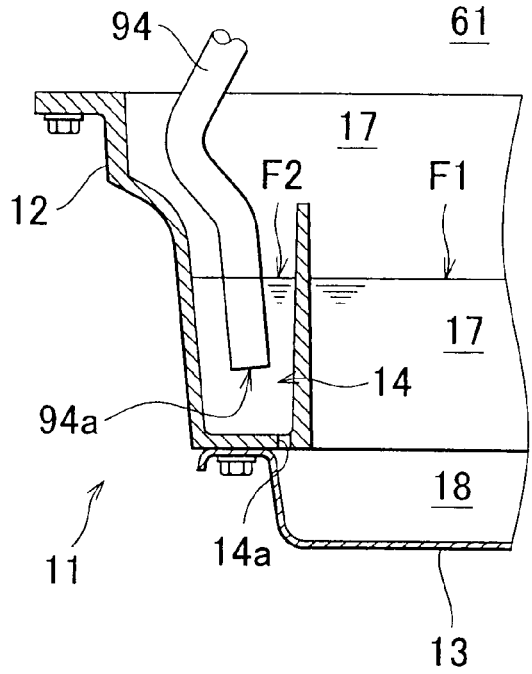
FIG. 6A shows a relationship of oil level positions between the oil pan and the reservoir during engine stop.
Figure 6B:
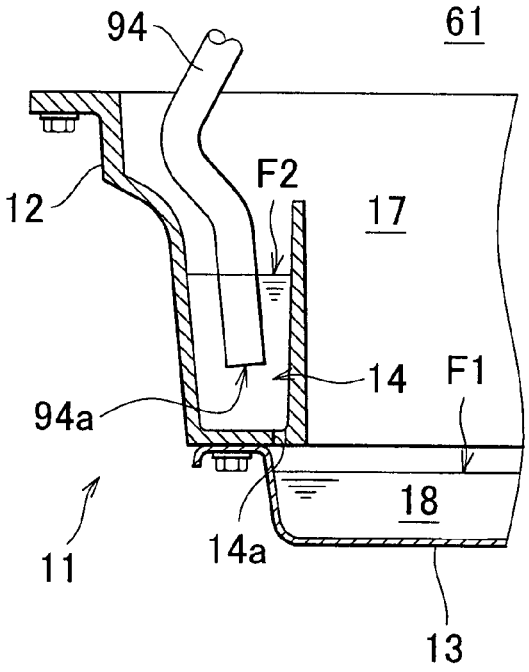
FIG. 6B shows a relationship of oil level positions between the oil pan and the reservoir during engine running.

As shown in FIG. 6A, when the engine E is stopped, the maximum amount of oil is reserved in the oil pan 11, and the oil level F1 in the oil pan 11 and the oil level F2 in the oil reservoir 14 are relatively higher than the corresponding oil levels during the engine E running (shown in FIG. 6B). When the engine E is stopped, the oil level F1 in the oil pan 11 and the oil level F2 in the oil reservoir 14 are at the same height. The oil level F2 in the oil reservoir 14 is predetermined to satisfy the relationship that the oil level F2 is above the downstream end 94*a* of the oil discharge pipe 94. In other words, when the engine E is stopped, the downstream end 94*a* of the oil discharge pipe 94 is submerged in oil in the oil reservoir 14. Therefore, oil in the oil reservoir 14 clogs the downstream end 94*a* of the oil discharge pipe 94, thereby preventing backflow of blow-by gas through the oil discharge pipe 94 toward the separator case 92 when the engine E starts. Accordingly, blow-by gas containing a large amount of vaporized oil is prevented from flowing into the intake system.

As shown in FIG. 6B, when the engine E is running, the oil amount in the oil pan 11 decreases, resulting in the lower oil level F1 in the oil pan 11. In turn, some oil flows through the oil discharge pipe 94 and some oil flows through the oil return hole 1*b* back to the oil reservoir 14, and is collected therein. When the engine E is running, the oil level F1 in the oil pan 11 is predetermined to satisfy the relationship that the oil level F1 is lower than the bottom surface 14*c* of the oil reservoir 14. This allows oil in the oil reservoir 14 to flow through the oil drain hole 14*a* of the oil reservoir 14 to the lower chamber 18 in the oil pan 11. As described above, in the oil return structure, the oil reservoir 14 protrudes inward, and has the oil drain hole 14*a* on the bottom surface 14*c* at its inwardly protruding portion. This ensures that oil does not stay at the bottom of the oil reservoir 14, but flows out of the oil reservoir 14 through the oil drain hole 14*a* (to the lower chamber 18). Thus, oil circulation improves. In addition to oil, sludge, and other materials also flow out of the oil reservoir 14 through the oil drain hole 14*a*, and are therefore prevented from accumulating in the oil reservoir 14.

In turn, when the engine E is running, the oil level F2 in the oil reservoir 14 is predetermined to satisfy the relationship that the oil level F2 is above the downstream end 94*a* of the oil discharge pipe 94. In other words, even when the oil level F1 in the oil pan 11 is lowered when the engine E is running, the downstream end 94*a* of the oil discharge pipe 94 remains submerged in oil in the oil reservoir 14. Thereby, oil, which flows through the oil discharge pipe 94 back to the oil reservoir 14, clogs the downstream end 94*a* of the oil discharge pipe 94. This prevents backflow of blow-by gas through the oil discharge pipe 94 toward the separator case 92 when the engine E is running. Accordingly, blow-by gas containing a large amount of vaporized oil is prevented from flowing into the intake system. The oil reservoir 14 may be provided on the upper part of the oil pan 11, so that the oil discharge pipe 94 is located where it does not interfere with the components in the crankcase 6.

The first embodiment describes the two-part structure of the oil pan 11 in which the oil pan 11 is divided into the upper case 12 and the lower case 13. Alternatively, the oil pan structure may be modified (e.g. one piece molding structure). Also, in the first embodiment, the oil reservoir 14 is provided at one of the corners of the upper case 12 in the oil pan 11. Alternatively, the oil reservoir may be provided at a different location (e.g. on one side of the upper case 12).

Further, in the first embodiment, the oil discharge pipe 94 in the PCV system 9 is located within the oil return hole 1*b*. Alternatively, the oil discharge pipe 94 may be located outside the oil return hole 1*b*. Still further, in the first embodiment, the oil return hole 1*b* may extend through the cylinder head 3L across the upper part of the cylinder block 1. However, the location of the oil return hole 1*b* is not specifically limited. For example, the oil return hole 1*b* may extend through the cylinder head 3L, the cylinder block 1, and the crankcase 6. Alternatively, no oil return hole may be formed.

In the first embodiment, the oil discharge pipe 94 serves as an oil return passage for returning oil from the upper part of the engine E to the oil reservoir 14 in the oil pan 11, that is, the oil discharge pipe 9 allows oil to flow from the oil separator 91 in the PCV system 9 back to the oil reservoir 14. Alternatively, any members, other than the oil discharge pipe, may be used as the oil return passage. According to the first embodiment, oil returns from the upper part of the engine E through the oil return passage to the oil reservoir 14 in the oil pan 11. However, it is not necessary to have the oil flow back from the oil separator 91 in the PCV system 9.

Figure 7:
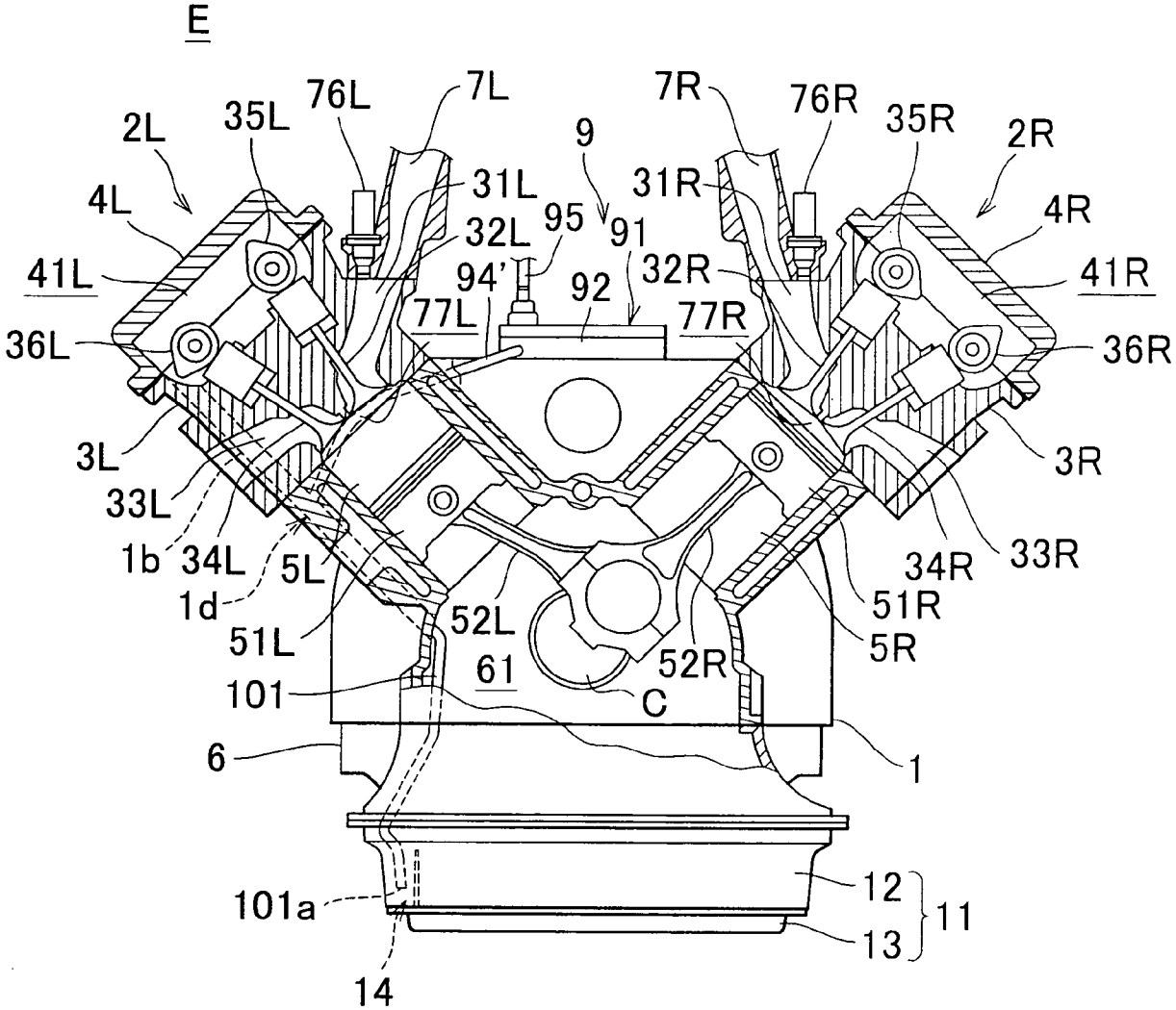
FIG. 7 illustrates one variation where a different oil return passage is used.

For example, oil returning from the upper part of the engine E to the oil reservoir 14 may include oil which flows from the cylinder head in the engine E back to the oil reservoir 14 after the oil is delivered to the cylinder head and lubricates the valve driving system. In this case, first oil returning from the cylinder head may join second oil returning from the separator 91 in the PCV system 9, as shown in FIG. 7. Then, the combined first and second oil may flow through an oil return pipe 101 back to the oil reservoir 14. In other words, the first oil returning from the cylinder head may flow back to the oil reservoir 14 through a common passage to the second oil returning from the oil separator 91. In contrast, the first oil returning from the cylinder head may flow back to the oil reservoir 14 through a different passage from the passage for the second oil returning from the oil separator 91.

To be briefly described, the variation shown in FIG. 7 is approximately the same as the first embodiment (see FIG. 1), except that a different oil return passage is used for returning oil to the oil reservoir 14 in the oil pan 11. According to this variation, the oil return hole 1*b*, an oil discharge pipe 94', and the oil return pipe 101 form the oil return passage for returning oil to the oil reservoir 14 in the oil pan 11. The oil return hole 1*b* is formed on one of the banks of the engine E (left bank 2L). The oil discharge pipe 94' extends from the oil separator 91 in the PCV system 9. The oil return pipe 101 serves as the oil return passage provided in the crankcase 6. Details of the oil return pipe 101 will be discussed later. The variation shown in FIG. 7 also uses the oil return structure, which is the same as in the first embodiment.

The upper end of the oil return hole 1*b* is open to the cam chamber 41L, while the lower end thereof connects to the upstream end of the oil return pipe 101. The oil return pipe 101 extends from the bottom end of the oil return hole 1*b* to the oil reservoir 14 in the oil pan 11. A downstream end 101*a* of the oil return pipe 101 is submerged in oil in the oil reservoir 14. The difference between the oil discharge pipe 94' and the oil discharge pipe 94 described in the first embodiment is that the pipe 94' extends from the oil discharge port of the oil separator 91 to a meeting point 1*d* where the pipe 94' and the oil return hole 1*b* meet. At the meeting point 1*d*, the oil discharge pipe 94' communicates with the oil return hole 1*b*. First oil returns from the oil separator 91 in the PCV system 9 through the oil discharge pipe 94' to the oil reservoir 14. Second oil returns through the oil return hole 1*b* to the oil reservoir 14 after being delivered to the cylinder head 3L and lubricating the valve driving system. This variation allows the first oil to join the second oil at the meeting point 1*d*. The combined first and second oil passes through the oil return hole 1*b* and the oil return pipe 101, and is collected in the oil reservoir 14 in the oil pan 11.

Figure 8:
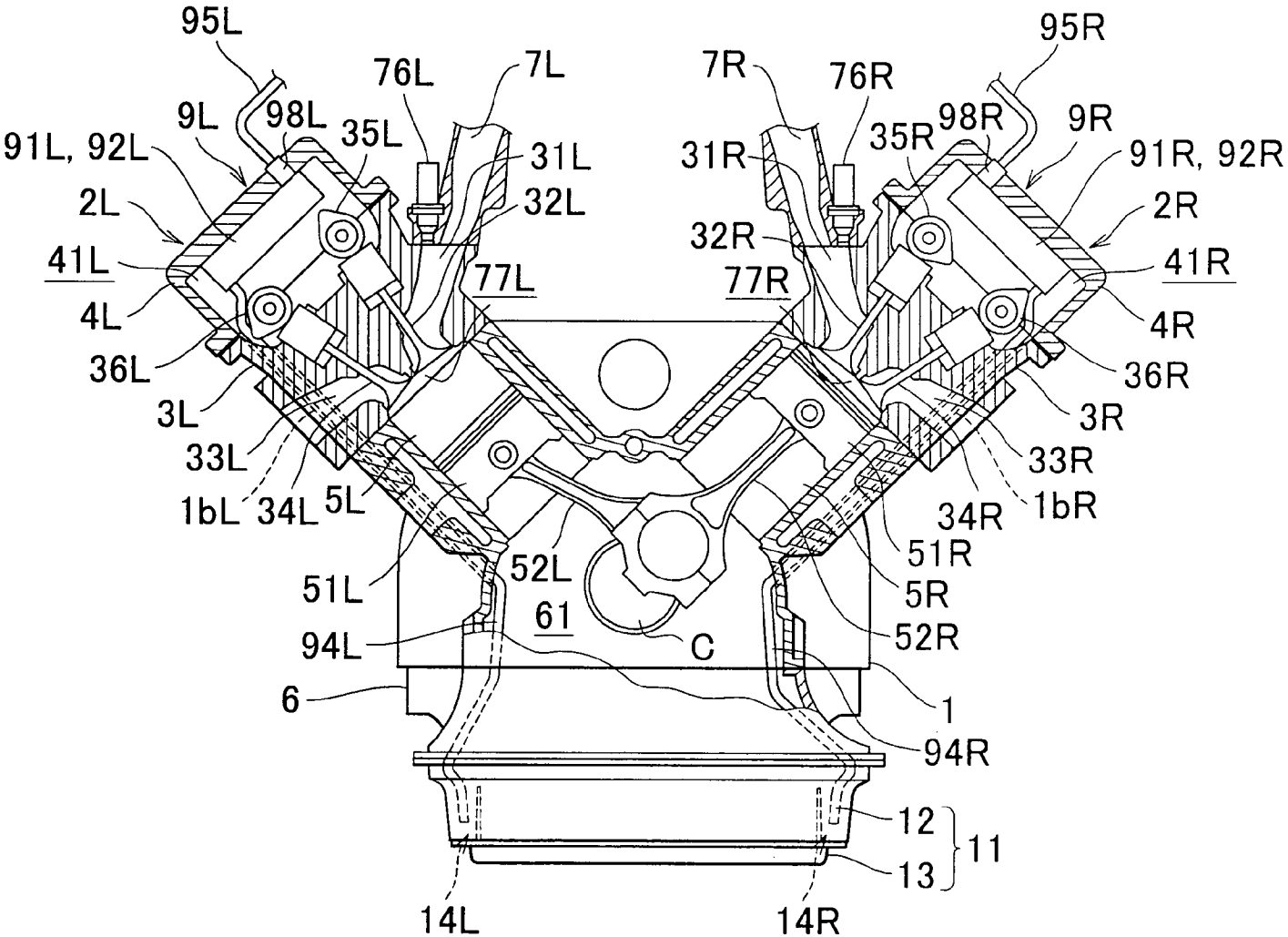
FIG. 8 illustrates another variation where a PCV system is provided inside the engine.

In the first embodiment, a V-type engine is employed. Alternatively, other types of engine may be used (e.g. in-line engine). For example, the invention may also be employed in an engine that is not provided with a PCV system. Further, according to the first embodiment, the separator case of the oil separator in the PCV system is provided outside the engine. Alternatively, the separator case of the oil separator in the PCV system may be provided inside the engine. As shown in FIG. 8, a V-type engine may be provided with separate PCV systems 9L and 9R for the left and right banks 2L and 2R, each PCV system having an oil separator 91L, 91R including a separator case 92L, 92R. In this case, the oil separators 91L and 91R may be provided within the head covers 4L and 4R, respectively.

Further, in the first embodiment, the single oil reservoir is solely provided in the oil pan. Alternatively, multiple oil reservoirs may be provided in the oil pan. For example, in the aforementioned case where the first oil to return from the cylinder head and the second oil to return from the PCV system separately flows through the different passages, individual oil reservoirs may be provided to reserve the first oil and the second oil therein. As described above, the V-type engine may be provided with separate PCV systems for the left and right banks, each PCV system having the oil separator including the separator case. In such case, as shown in FIG. 8, the first oil and the second oil may respectively flow from the separator cases 92L and 92R of the oil separators 91L and 91R in the PCV systems 9L and 9R back to separate oil reservoirs 14L and 14R.

The other variation shown in FIG. 8 is substantially the same as the first embodiment (see FIG. 1), except the following point. The variation shown in FIG. 8 also uses the oil return structure, which is the same as in the first embodiment.

In the engine E, the respective banks 2L and 2R are provided with oil return holes 1*b*L and 1*b*R. The oil return holes 1*b*L and 1*b*R are designed to return oil, used for lubricating the valve driving system of the engine E, to the oil pan 11. Upper ends of the respective oil return holes 1*b*L and 1*b*R are open to the cam chambers 41L and 41R, while lower ends thereof are open to the crank chamber 61. This allows oil, which has been delivered to the cam chambers 41L and 41R and lubricated the valve driving system, to drop back down into the oil pan 11 through the oil return holes 1*b*L and 1*b*R. Oil flowing out of the bottom ends of the oil return holes 1*b*L and 1*b*R drops down into the oil pan 11 through the crank chamber 61.

The engine E is provided with the separate PCV systems 9L and 9R for each bank 2L and 2R of the engine E. Each PCV system includes an oil-separator 91L, 91R and a separator case 92L, 92R. More specifically, the respective separator cases 92L and 92R are mounted to the inner surface (underside) of the head covers 4L and 4R. Oil discharge pipes 94L and 94R connect to the separator cases 92L and 92R, respectively. The oil discharge pipes 94L and 94R are designed to return oil, separated from blow-by gas in the separator cases 92L and 92R, to the oil pan 11. Blow-by gas discharge pipes 95L and 95R connect to the separator cases 92L and 92R, respectively. The blow-by gas discharge pipes 95L and 95R are designed to direct blow-by gas, whose oil content is separated and removed, to the intake system of the engine E. PCV valves 98L and 98R are provided at the respective upstream ends of the blow-by gas discharge pipes 95L and 95R. The separator cases 92L and 92R have respective blow-by gas introducing holes (not shown) for directing blow-by gas, which are drawn through the crank chamber 61, into the separator cases 92L and 92R.

The oil reservoirs 14L and 14R are formed respectively on the left end and the right end of the upper case 12 in the oil pan 11. The oil reservoirs 14L and 14R are the same as the oil reservoir 14 in the first embodiment (see FIG. 4) in construction. An oil drain hole (not shown) is formed on each bottom surface of the oil reservoirs 14L and 14R.

The oil discharge pipes 94L and 94R are located inside the engine E. The oil discharge pipes 94L and 94R extend from the oil discharge ports of the separator cases 92L and 92R to the oil reservoirs 14L and 14R in the oil pan 11, respectively. Parts of the oil discharge pipes 94L and 94R, which are located in the banks 2L and 2R, are inserted into the oil return holes 1*b*L and 1*b*R, respectively. The other parts of the oil discharge pipes 94L and 94R, which are downstream of the oil return holes 1*b*L and 1*b*R, extend from the bottom ends thereof respectively through the crank chamber 61. In the crank chamber 61, the downstream portions of the oil discharge pipes 94L and 94R are located along the inner walls of the crankcase 6 respectively to avoid interference with components therein. The respective downstream ends of the oil discharge pipes 94L and 94R are introduced into the oil reservoirs 14L and 14R in the oil pan 11.

Figure 9:
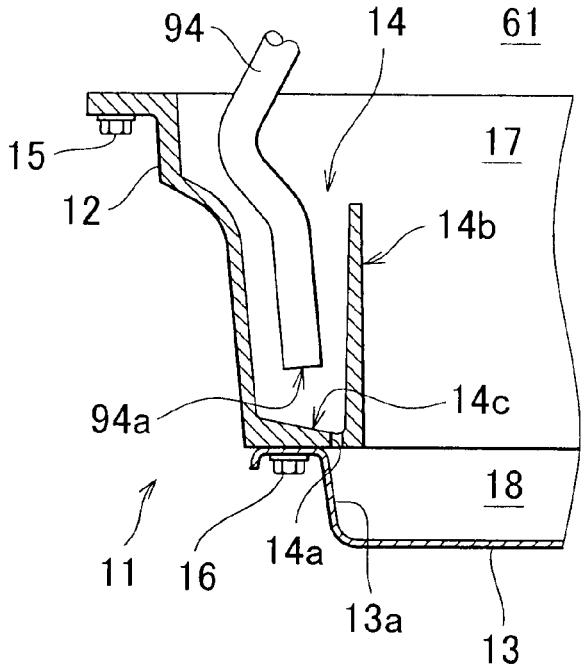
FIG. 9 is a sectional view of an oil reservoir in an oil pan according to the second embodiment of the invention.

FIG. 9 shows the second embodiment of the invention, which is similar to the first embodiment (see FIG. 4), but differs from the first embodiment in the following way. The second embodiment shown in FIG. 9 also uses the oil return structure, which is the same as in the first embodiment. The second embodiment shown in FIG. 9 differs from the first embodiment in that a part of the bottom surface 14*c* of the oil reservoir 14 is tilted downward toward the oil discharge hole 14*a*.

Figure 10:
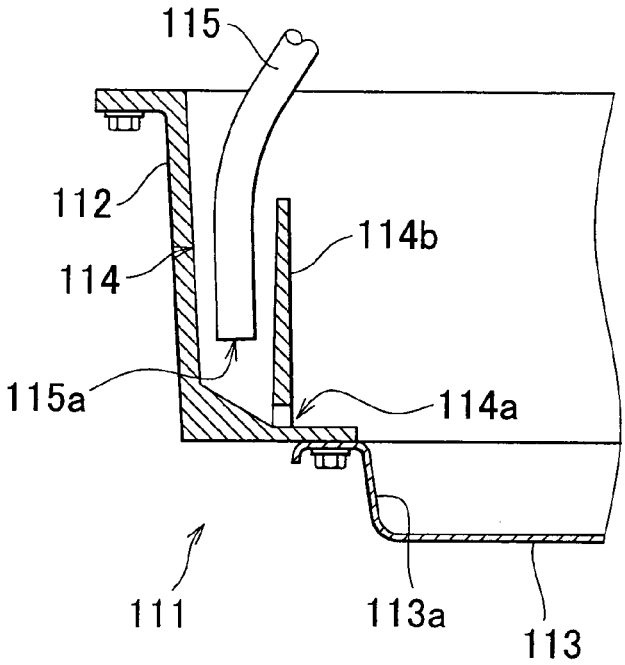
FIG. 10 is a sectional view of an oil reservoir in an oil pan according to the third embodiment of the invention.
Figure 11:
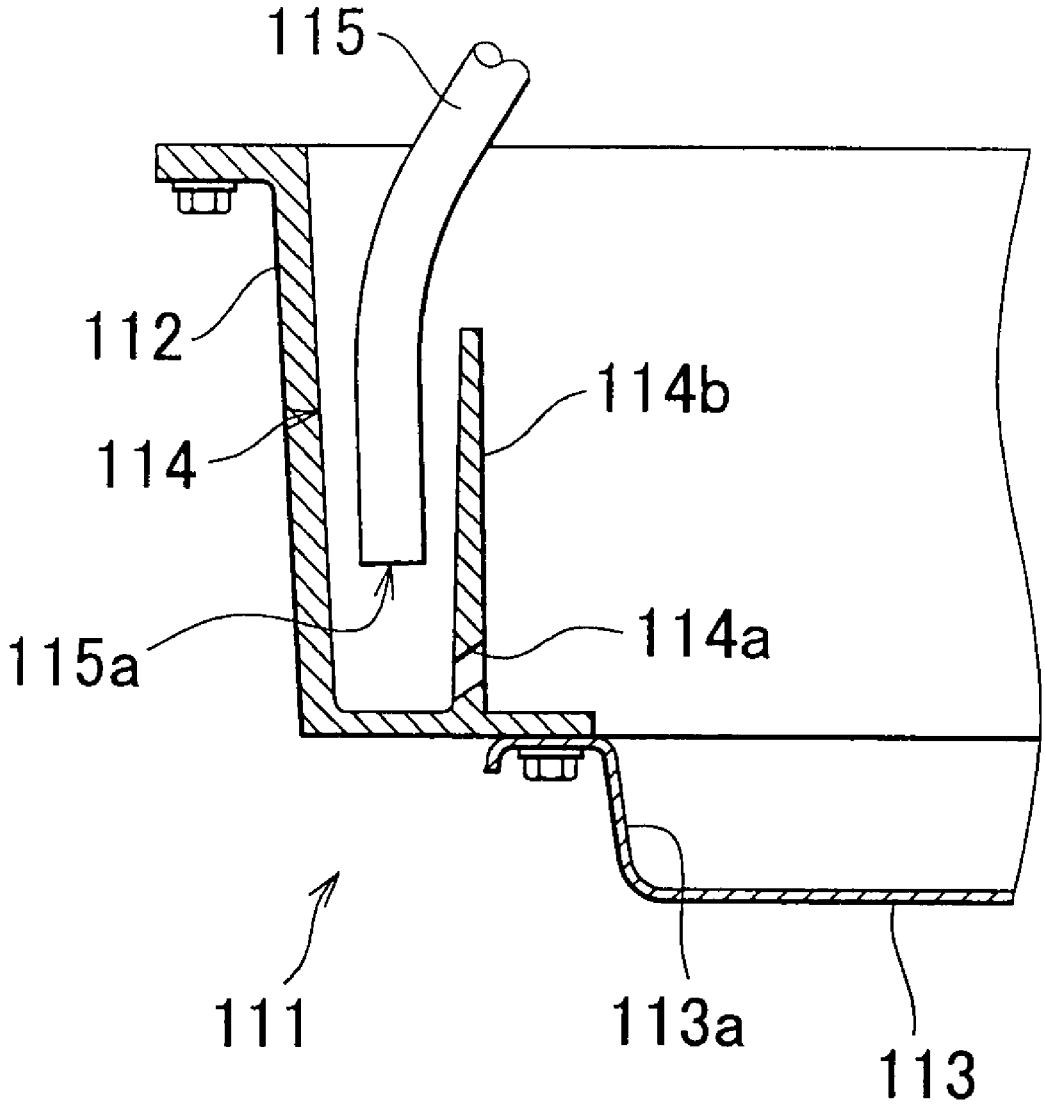
FIG. 11 is a sectional view of a related-art oil pan structure.

FIG. 10 shows the third embodiment of the invention, which is similar to the related art shown in FIG. 11, but differs from the related art in the following way. Specifically, the third embodiment shown in FIG. 10 differs from the related art in that a part of the bottom surface of the oil reservoir 114 is tilted downward toward the oil discharge hole 114*a*.

What is claimed is:

1. An oil return structure for an internal combustion engine, comprising:

an oil pan located below a crankcase of the internal combustion engine;

an oil return passage provided in the crankcase for returning oil from an upper part of the internal combustion engine into the oil pan; and an oil reservoir formed in an upper part of the oil pan, wherein the oil return passage has a downstream end located within the oil reservoir, the oil reservoir protrudes inward of an inner wall surface of a lower part of the oil pan, an oil discharge hole is formed on a bottom surface of the oil reservoir at an inwardly protruding portion of the oil reservoir, and the oil reservoir communicates through the oil discharge hole with a space defined by the lower part of the oil pan.

2. The oil return structure according to claim 1, wherein at least a part of the oil return passage also serves as an oil discharge pipe that extends from an oil separator of a positive crankcase ventilation system provided on a top of the internal combustion engine.

3. The oil return structure according to claim 1, wherein the oil discharge pipe extends from the oil separator of the positive crankcase ventilation system, provided on the top of the internal combustion engine, through the at least a part of the oil return passage.

4. The oil return structure according to claim 1, wherein a predetermined oil level in the oil reservoir is above the downstream end of the oil return passage when the internal combustion engine is stopped, and a predetermined oil level in the oil pan is below the bottom surface of the oil reservoir, while the predetermined oil level in the oil reservoir is above the downstream end of the oil return passage when the internal combustion engine is running.

5. The oil return structure according to claim 1, further comprising:

a plurality of positive crankcase ventilation systems provided on the top of the internal combustion engine;

an oil separator, provided in each positive crankcase ventilation system of the plurality of positive crankcase ventilation systems;

an oil discharge pipe that extend from the oil separator of each positive crankcase ventilation system, wherein separate oil reservoirs are provided for each oil discharge pipe.

6. The oil return structure according to claim 1, wherein a bottom wall of the oil reservoir, forming the bottom surface of the inwardly protruding portion of the oil reservoir, faces a bottom surface of the lower part of the oil pan.

7. The oil return structure according to claim 1, wherein at least a part of the bottom surface of the oil reservoir is tilted downward toward the oil discharge hole.

8. An oil return structure for an internal combustion engine, comprising:

an oil pan located below a crankcase of the internal combustion engine;

an oil return passage provided in the crankcase for returning oil from an upper part of the internal combustion engine into the oil pan; and an oil reservoir formed in an upper part of the oil pan, wherein the oil return passage has a downstream end located within the oil reservoir, an oil discharge hole is formed on a side surface of the oil reservoir at a lowest part of the oil reservoir, the oil reservoir communicates through the oil discharge hole with a space defined by a lower part of the oil pan, and at least a part of the bottom surface of the oil reservoir is tilted downward toward the oil discharge hole.

* * * * *